US006840330B2

(12) United States Patent
Lancaster

(10) Patent No.: US 6,840,330 B2
(45) Date of Patent: Jan. 11, 2005

(54) APPARATUS AND METHOD OF EXTINGUISHING FIRES

(76) Inventor: David W. Lancaster, Coastal Industrial Services, South Houston, TX (US) 77587

( * ) Notice: Subject to any disclaimer, the term of this patent is extended or adjusted under 35 U.S.C. 154(b) by 0 days.

(21) Appl. No.: 10/815,737

(22) Filed: Apr. 2, 2004

(65) Prior Publication Data

US 2004/0194979 A1 Oct. 7, 2004

Related U.S. Application Data

(63) Continuation-in-part of application No. 10/044,924, filed on Jan. 15, 2002, now abandoned.

(51) Int. Cl.[7] ..... A62C 13/62
(52) U.S. Cl. ..... 169/70; 169/47
(58) Field of Search ..... 169/37, 24, 43, 169/47, 52, 54, 70; 239/159, 164, 165, 166, 172, 271, 554, 555, 556, 557, 559, 567, 560, 600

(56) References Cited

U.S. PATENT DOCUMENTS

| | | | |
|---|---|---|---|
| 2,813,753 | A | 11/1957 | Roberts |
| 2,857,005 | A | 10/1958 | Medlock |
| 3,104,720 | A | 9/1963 | Sullivan |
| 4,802,535 | A | 2/1989 | Bakke |
| 5,301,756 | A | 4/1994 | Relyea et al. |
| 5,788,158 | A | 8/1998 | Relyea |
| 5,839,664 | A | 11/1998 | Relyea |
| 6,298,945 | B1 | 10/2001 | Anders et al. |

*Primary Examiner*—Michael Mar
*Assistant Examiner*—Thach H. Bui
(74) *Attorney, Agent, or Firm*—Richard C. Litman

(57) ABSTRACT

An apparatus and method for extinguishing a fire in a burning building includes a hollow, conically-shaped, hardened metallic device attached to an articulating arm of a boom. The device is provided with plural nozzles formed through its outer surface. The device is impelled from the articulating arm to impact and crash through the building adjacent the fire. Fire extinguishing fluids are supplied via the plural nozzles to extinguish the fire.

20 Claims, 4 Drawing Sheets

APPARATUS AND METHOD OF EXTINGUISHING FIRES

CROSS-REFERENCE TO RELATED APPLICATIONS

This application is a continuation-in-part of application Ser. No. 10/044,924 filed Jan. 15, 2002 now abandoned.

BACKGROUND OF THE INVENTION

1. Field of the Invention

The present invention generally relates to fire fighting equipment. More specifically, the present invention is drawn to an apparatus and method for delivering fire extinguishing fluids to a burning structure.

2. Description of the Related Art

One of the more difficult and dangerous functions of fire fighting requires that fire-fighting personnel manually utilize tools (axes, saws, mallets, etc.) to break through building roofs, barred windows or walls to reach the origin of the fire and apply extinguishing fluids to the fire. Many fatalities and injuries have occurred simply because the personnel are in such close proximity when roofs or walls collapse. Providing durable, rugged, reliable apparatus whereby this function may be accomplished remotely and efficiently would certainly decrease risks and increase effectiveness in fire fighting techniques.

There are many related art devices that are employed to penetrate the walls of burning structures. For example, U.S. Pat. No. 2,857,005 (Medlock) and U.S. Pat. No. 5,301,756 (Relyea et al.) disclose tools designed to pierce an aircraft fuselage and deliver fire-extinguishing fluids to the burning interiors of the aircraft. The tools of the instant patents appear to be too fragile to withstand the impact required to break through barred windows, re-enforced concrete walls or roofs of buildings.

U.S. Pat. No. 2,813,753 (Roberts), U.S. Pat. No. 4,802,535 (Bakke) and U.S. Pat. No. 5,839,664 (Relyea) show fire-fighting tools having pointed tips which function to penetrate a wall of a building.

The tips of the tools are designed to produce a relatively small opening and would only extinguish the fire at the inner surface of the penetrated wall.

U.S. Pat. No. 3,104,720 (Sullivan) requires firemen to be positioned closely adjacent a device, which device is employed to bore a hole through a roof to allow application of fire retardant materials.

U.S. Pat. No. 5,788,158 (Relyea) discloses an automatic leveling device for a fluid nozzle mounted on the outer end of an aerial boom. No provision is made for the nozzle to penetrate the walls or roof of a building.

U.S. Pat. No. 6,298,945 B1 (Anders et al.) shows a cone-shaped, roof-venting device mounted on an aerial extension ladder. The device is to be dropped on the roof of a burning building, thereby creating a hole in the roof. It is to be noted that the device does not provide for a continuous supply of fire extinguishing fluids to the fire.

None of the above inventions and patents, taken either singularly or in combination, is seen to disclose fire extinguishing method and apparatus as will be subsequently described and claimed in the instant invention.

SUMMARY OF THE INVENTION

The present invention, to be dubbed "The Fifth Man" includes a cone-shaped device having an exterior surface that defines a hollow interior. The exterior surface is provided with a plurality of nozzles, which nozzles communicate with the hollow interior. The lower, tapered end of the device has an array of hardened cutter blades disposed there around. The upper end of the device has an entry opening adapted to receive the exit end of a standard fire hose or the like. The device is designed for attachment to a conventional articulating boom.

In use, the articulating boom impels the device forcefully against a roof or wall of a burning structure such as a house or apartment building. The hardened cutter blades function to create a hole in the structure, thereby permitting the device to be forced through the walls or roof. A fire-extinguishing fluid (water or foam) is supplied via the entry opening into the interior of the device. The fluid will exit the device through the plural nozzles to extinguish the fire. A group of nozzles in the mid-section of the device are removable and interchangeable so that the rate of exiting fluid can be metered. The apparatus of the present invention is especially useful when fighting fires in multi-story structures. The above procedure is accomplished remotely without requiring that fire personnel be positioned in harm's way.

Accordingly, the device allows fire fighters to quickly and efficiently access a fire via a wall and/or roof of a burning structure and to apply fire extinguishing fluids to the fire from a remote position. The invention provides for improved elements and arrangements thereof for the purposes described which are inexpensive, dependable and fully effective in accomplishing their intended purposes.

A clear understanding of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
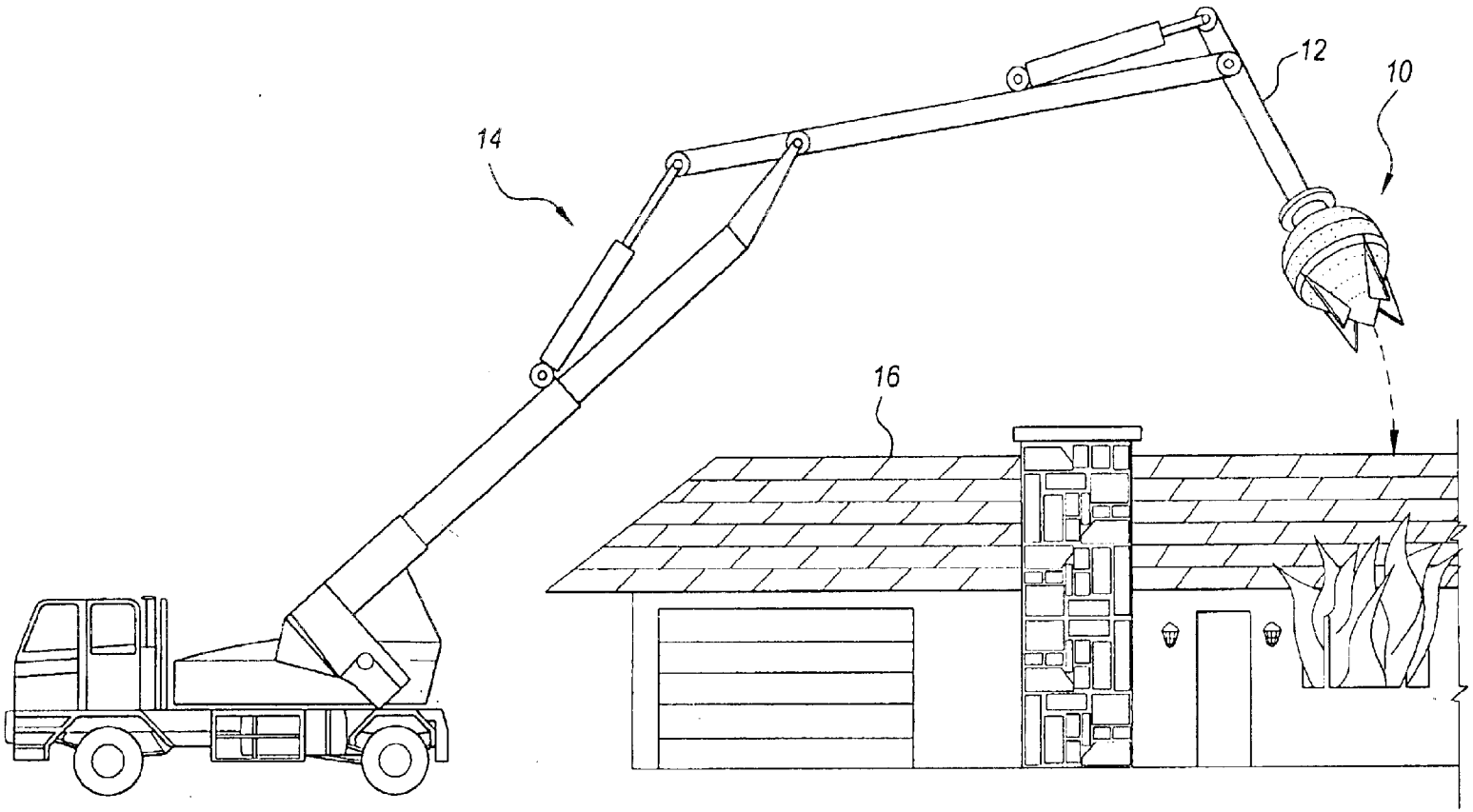
FIG. 1 is an environmental, perspective view of a boom and extinguishing device according to the present invention.

Attention is directed to FIG. 1 wherein the extinguishing device of the present invention is generally indicated at 10. Device 10 is mounted at the end of the articulating arm 12 of a boom generally indicated at 14. As stated above, boom 14 and arm 12 are conventional and are not, per se, a part of the inventive concept. Boom 14 is fitted with lines (not shown) to supply fire extinguishing fluids to device 10. The boom can be equipped with a conventional hydraulic accumulator (not shown) that would function to forcefully impel device 10 from the boom against a wall or roof of a burning building 16. The rugged device will create a hole in the wall or roof providing access to the fire. Fire extinguishing fluids can be applied to the fire through apertures in the device as will be further explained below.

Figure 2:
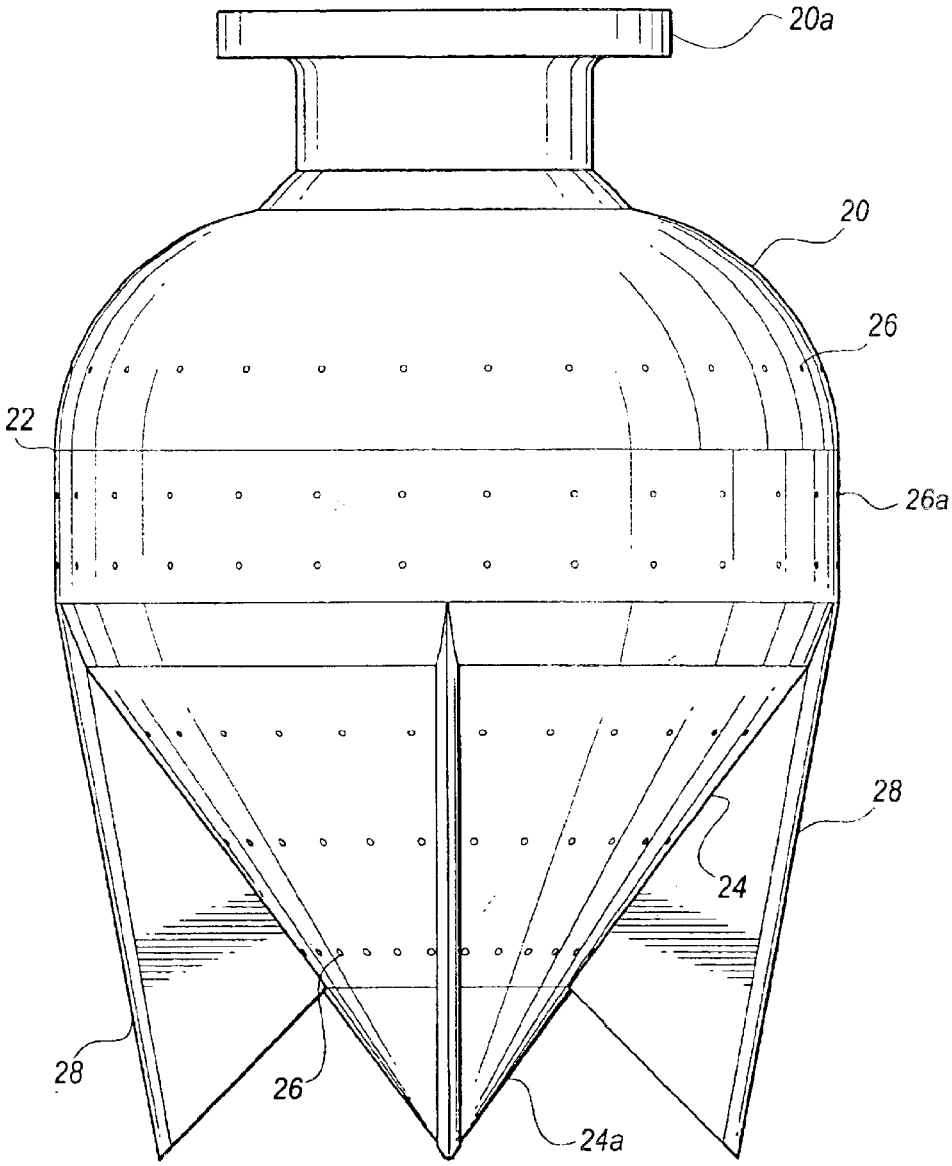
FIG. 2 is a plan view of an extinguishing device according to the present invention.
Figure 3:
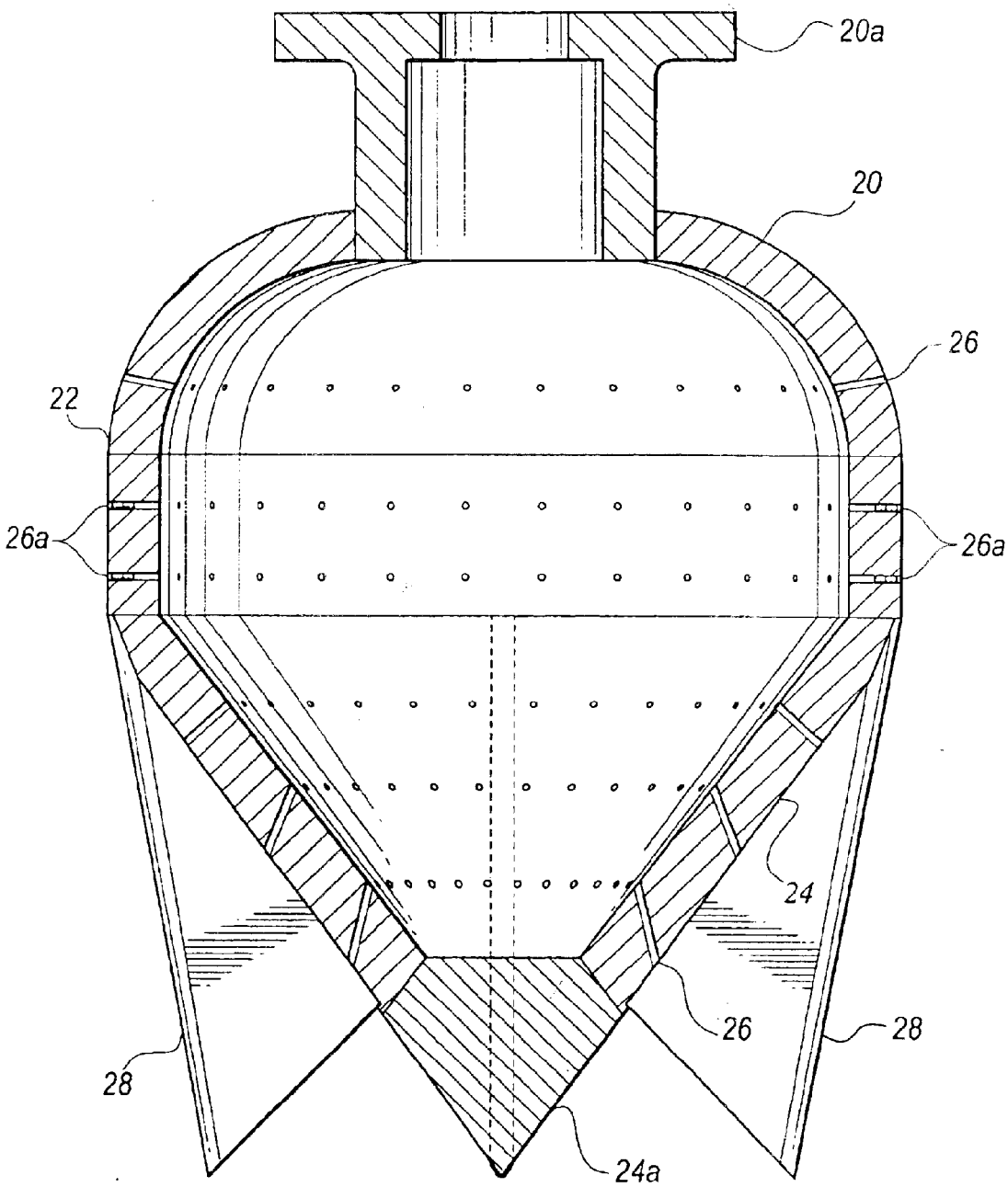
FIG. 3 is a cross-sectional view of an extinguishing device according to the present invention.

The structural make-up of device 10 is illustrated more clearly in FIGS. 2 and 3. Device 10 is formed with an exterior surface having upper, middle and lower sections, which sections define walls enclosing an interior volume.

Figure 4:
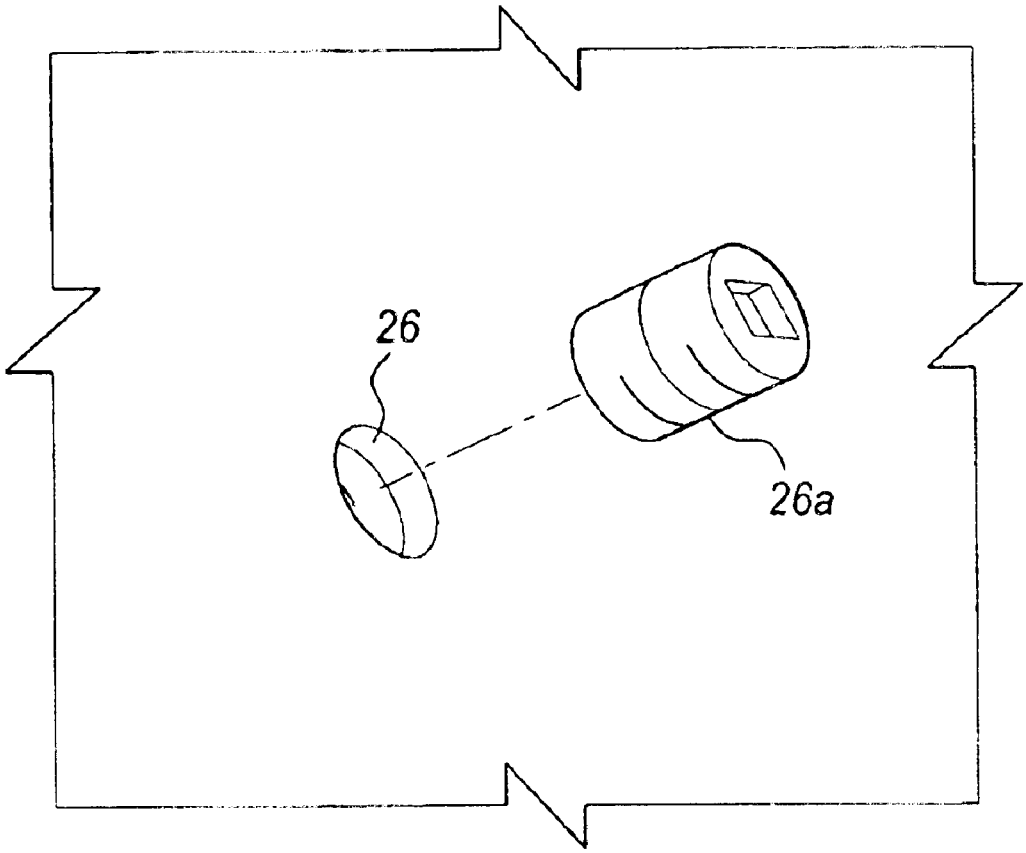
FIG. 4 is a perspective view of a removable nozzle according to the present invention.

The upper section is defined by a cap portion 20, which cap portion is of semi-hemispherical configuration. The upper end of cap 20 terminates in a flanged adapter 20*a*. Adapter 20*a* is sized to readily connect with the outlet of a fire hose or the like. A middle cylindrical section 22 is attached at one end to the lower end of cap section 20. A conical lower section 24 is attached to the other end of section 22. Lower section 24 terminates in a nose cone 24*a*. Plural nozzles 26, 26*a* are disposed through each of the sections and open into the interior volume. At least four cutter blades 28 are evenly spaced around lower section and are attached thereto. The nozzle array in section 20 is oriented to issue extinguishing fluids in a slightly upward direction. The middle section 22 contains an array of recessed, threaded apertures for receiving nozzles 26*a*, which nozzles have exterior threaded surfaces (FIG. 4) so as to be removable and replaceable. This feature allows the fire fighter to meter the amount of extinguishing fluid by selecting a nozzle having an orifice and producing a spray pattern conducive to extinguishing a particular type fire. Since the nozzles are mounted in the recesses, they are protected from damage during impact. An array of nozzles having different orifice sizes will be made available to the firefighter. Fluids issue from section 24 in a downward direction. The varied nozzle orientation allows the issued extinguishing fluids to effectively attack the fire from multiple directions. All components of device 10 are fabricated from hardened metallic materials so as to present a rugged structure capable of withstanding the rigors of pounding against the walls and roofs of buildings and the attendant heat generated by the fire. The device weighs approximately 1,200 pounds and has a height of 24 inches. The middle section has a diameter of 18 inches. Components are attached to each other by welds or the like.

It is to be understood that the present invention is not limited to the embodiment described above, but encompasses any and all embodiments within the scope of the following claims.

I claim:

1. A device for extinguishing fires comprising:

an upper section, said upper section having an upper end and a lower end;

a lower section, said lower section having a first end and a second end;

a middle section, said middle section interposing said upper section and said lower section, said middle section attached to said lower end of said upper section and to said first end of said lower section;

exterior wall surfaces defined by said upper section, said middle section and said lower section, said exterior wall surfaces enclosing an interior volume;

a plurality of apertures disposed through said exterior wall surfaces in each of said upper section, said middle section and said lower section, said plurality of apertures opening into said interior volume;

removable nozzles disposed in the apertures of said middle section; and an array of cutter blades positioned on and evenly spaced around the exterior wall surfaces of said lower section.

2. A device as recited in claim 1, including a flanged adapter member, said flanged adapter member attached to said upper end of said upper section.

3. A device as recited in claim 1, wherein said upper section is of semi-hemispherical configuration.

4. A device as recited in claim 1, wherein said middle section is of cylindrical configuration.

5. A device as recited in claim 1, wherein said lower section is of conical configuration.

6. A device as recited in claim 5, wherein said second end of said lower section terminates in a solid nose cone.

7. A device as recited in claim 6, wherein said upper section said middle section, said lower section, said array of cutter blades and said nose cone are fabricated from hardened metallic material.

8. A device as recited in claim 7, wherein there are at least four cutter blades in said array of cutter blades.

9. A device as recited in claim 1, wherein said recessed apertures are threaded.

10. A device as recited in claim 9, wherein each said removable nozzles has an exterior surface and wherein said exterior surface is threaded.

11. A fire extinguishing apparatus comprising:

a boom, said boom having an articulated arm structure;

a device for extinguishing fires detachably mounted to said articulated arm structure, said device weighing approximately 1,200 pounds and including;

an upper section, said upper section having an upper end and a lower end;

a lower section, said lower section having a first end and a second end;

a middle section, said middle section interposing said upper section and said lower section, said middle section attached to said lower end of said upper section and to said first end of said lower section;

exterior wall surfaces defined by said upper section, said middle section and said lower section, said exterior wall surfaces enclosing an interior volume;

a plurality of apertures disposed through said exterior wall surfaces and opening into said interior volume, wherein the apertures in said middle section are recessed;

removable nozzles disposed in said recessed apertures in said middle section; and at least four cutter blades positioned on and evenly spaced around the exterior wall surfaces of said lower section.

12. A fire extinguishing apparatus recited in claim 11, including a flanged adapter member, said flanged adapter member attached to said upper end of said upper section.

13. A fire extinguishing apparatus recited in claim 11, wherein said upper section is of semi-hemispherical configuration.

14. A fire extinguishing apparatus recited in claim 11, wherein said middle section is of cylindrical configuration.

15. A fire extinguishing apparatus recited in claim 11, wherein said lower section is of conical configuration and wherein said second end of said lower section terminates in a solid nose cone.

16. A fire extinguishing apparatus recited in claim 11, wherein said upper section said middle section, said lower section, said array of cutter blades and said nose cone are fabricated from hardened metallic material.

17. A method of extinguishing a fire in a burning building said building having a roof and at least one wall comprising the steps of:

providing a boom, said boom having an articulating arm structure;

providing a conically-shaped member fabricated from hardened metallic material and weighing approximately 1,200 pounds, said conically-shaped member having an exterior surface enclosing an interior volume, said exterior surface having a plurality of apertures communicating with said interior volume;

removably attaching said conically-shaped member to said articulating arm structure;

impelling said conically-shaped member from said articulating arm such that said conically-shaped member impacts said burning building closely adjacent said fire; and continuously supplying a fire extinguishing fluid to said interior volume of said conically-shaped member, whereby said fluid exits said interior volume via said plurality of apertures to extinguish said-fire.

18. The method as recited in claim 17, wherein said conically-shaped member is impelled to impact said at least one wall of said burning building.

19. The method as recited in claim 17, wherein said conically-shaped member is impelled to impact said roof of said burning building.

20. The method as recited in claim 17, wherein said fire extinguishing fluid is taken from the group consisting of water and foam.

* * * * *